US007381078B2

(12) United States Patent
Mtchedlishvili et al.

(10) Patent No.: US 7,381,078 B2
(45) Date of Patent: Jun. 3, 2008

(54) CONNECTOR ASSEMBLY

(75) Inventors: George Mtchedlishvili, Hallandale, FL (US); Jody H. Akens, Weston, FL (US); Adrian F. Rubio, Pompano Beach, FL (US)

(73) Assignee: Motorola, Inc., Schaumburg, IL (US)

( * ) Notice: Subject to any disclaimer, the term of this patent is extended or adjusted under 35 U.S.C. 154(b) by 1038 days.

(21) Appl. No.: 10/801,775

(22) Filed: Mar. 16, 2004

(65) Prior Publication Data

US 2005/0208818 A1 Sep. 22, 2005

(51) Int. Cl.
*H01R 13/627* (2006.01)

(52) U.S. Cl. ..... 439/352; 439/358

(58) Field of Classification Search ..... 439/352, 439/358, 350, 351, 353–357
See application file for complete search history.

(56) References Cited

U.S. PATENT DOCUMENTS 5,295,855 A * 3/1994 Walz ..... 439/354
6,244,890 B1 * 6/2001 Fuerst et al. ..... 439/357
6,364,699 B1 * 4/2002 Hwang et al. ..... 439/555
6,616,473 B2 * 9/2003 Kamata et al. ..... 439/352
6,793,516 B1 * 9/2004 Mamas ..... 439/344
6,821,024 B2 * 11/2004 Bates, III ..... 385/76
6,824,417 B1 * 11/2004 Nimura ..... 439/352
7,052,186 B1 * 5/2006 Bates ..... 385/59
7,204,721 B2 * 4/2007 Lundholm et al. ..... 439/676

* cited by examiner

*Primary Examiner*—Gary F. Paumen
(74) *Attorney, Agent, or Firm*—Barbara R. Doutre

(57) ABSTRACT

A connector assembly (100) provides improved locking and retention through the use of a cylindrical body (102) having locking arms (104) extending therefrom and a malleable collar (106) that includes an integrally molded interior lip (114) and exterior bumps (116). The malleable collar (106) is slid over a portion of the cylindrical body (102) such that the bumps (116) align with the locking arms (104). Upon insertion of the connector (100) into a housing receptacle, the locking arms (104) compress the bumps (116) thereby providing resistance to aid with retention while the interior lip (114) abuts the cylindrical body (102) which facilitates sealing the receptacle.

12 Claims, 2 Drawing Sheets

CONNECTOR ASSEMBLY

TECHNICAL FIELD

This invention relates in general to connector assemblies and more particularly to retention features associated with such assemblies.

BACKGROUND

Communication products, such as mobile radios, must operate in adverse environments. The automotive environment is one example where products are subjected to extreme variations in temperature and vibration. Connectors that are used in such products usually have a locking mechanism. However, there are several issues with connector locking mechanisms. Plastic retention features on the locking mechanism of the connector tend to deform over time, particularly during hot weather, causing accessories to unplug. While additional retention components such as springs, can be added to facilitate retention, these components increase the manufacturing cost and make assembly more cumbersome.

Accordingly, there is a need for a connector assembly with improved retention features.

BRIEF DESCRIPTION OF THE DRAWINGS

The features of the present invention, which are believed to be novel, are set forth with particularity in the appended claims. The invention, together with further objects and advantages thereof, may best be understood by reference to the following description, taken in conjunction with the accompanying drawings, in the several figures of which like reference numerals identify like elements, and in which:

DETAILED DESCRIPTION OF THE PREFERRED EMBODIMENT

Figure 1:
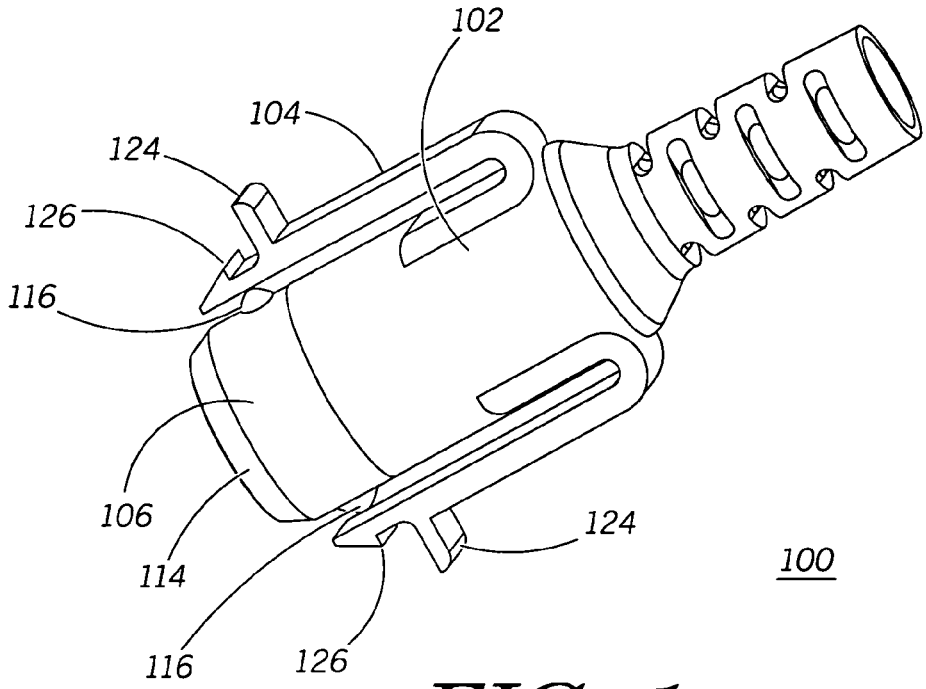
FIG. 1 is an assembled view of the connector assembly in accordance with the present invention.

While the specification concludes with claims defining the features of the invention that are regarded as novel, it is believed that the invention will be better understood from a consideration of the following description in conjunction with the drawing figures, in which like reference numerals are carried forward.

Figure 2:
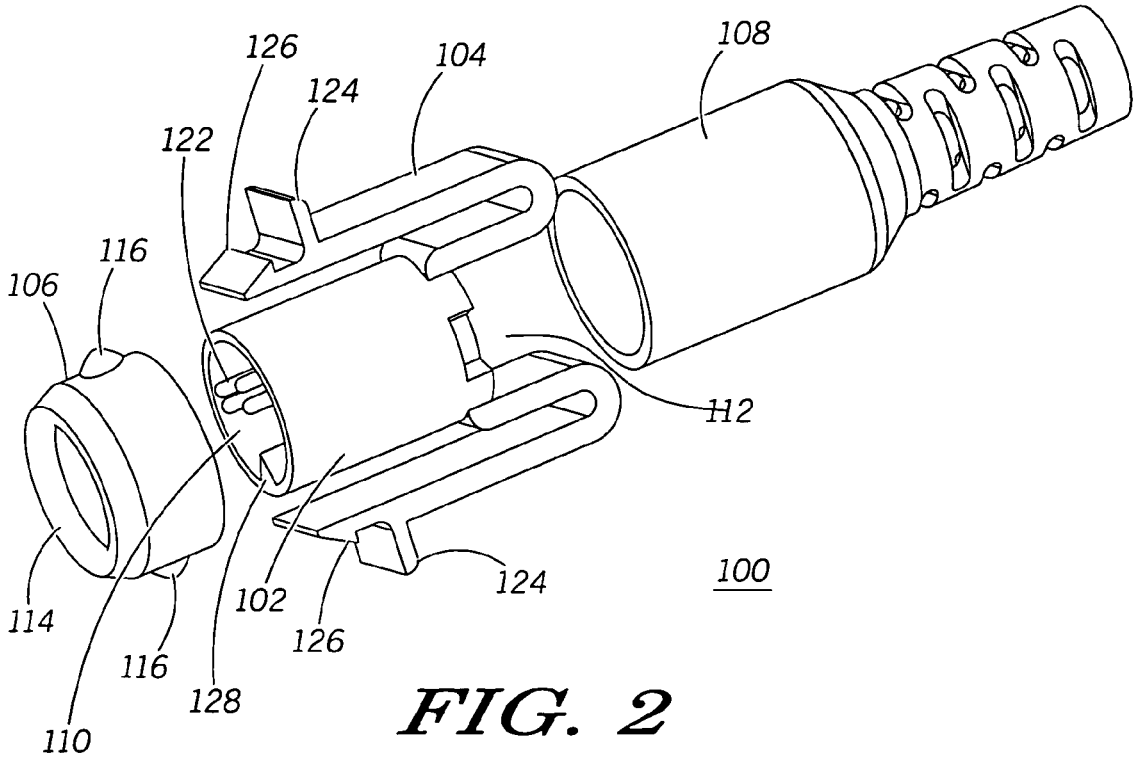
FIG. 2 is a an exploded view of the connector assembly in accordance with the present invention.

In accordance with the present invention there is provided herein a connector assembly having an improved locking and retention mechanism. FIG. 1 is a completed assembly of the connector of the present invention while FIG. 2 is a corresponding exploded view. In accordance with the present invention, connector assembly 100 includes a cylindrical body 102, at least one locking arm 104 extending therefrom, and an integrally molded malleable collar 106 shaped to provide both resistance and sealing to a receptacle. A strain relief 108 is overmolded to the cylindrical body 102 such that the locking arm 104 is left exposed. The cylindrical body 102 is preferably formed as a unitary molded portion of substantially rigid material having the ability to deflect, such as a polymer or similar material known in the art. The malleable collar is preferably formed as a second unitary molded portion of silicone or other material having elastic elastomeric characteristics. The strain relief is formed of material that can deform for overmold purposes known in the art.

In accordance with the present invention, cylindrical body 102 has a first end and a second end which will be referred to as the front end 110 and the back end 112 of the connector. Cylindrical body 102 includes contact pins 122 for coupling to a mating receptacle, shown in FIG. 4. The locking arms 104 extend upward from the back end 112 and turn downward alongside the cylindrical body 102 toward front end 110 thus forming a "u" shaped member. The "u" shaped member allows the arm to be compressible though made out of the same substantially rigid material as the cylindrical body 102. The malleable collar 106 slides over the front end 110 of the cylindrical body 102. In accordance with the present invention, the malleable collar 106 includes an integrally molded interior lip 114 for abutting with the front end of the cylindrical body 102. The lip 114 provides sealing to a mating receptacle 404, shown in FIG. 4.

In accordance with the present invention, the malleable collar 106 further includes at least one integrally molded exterior bump 116 that aligns between the at least one locking arm 104 and cylindrical body 102 to provide resistance to the locking arm when the locking arm is compressed. For best connectivity, at least one bump 116 should be provided for every locking arm 104. Each locking arm 104 preferably includes a stop tab 124 with a latch 126 integrally molded therein to retain the connector against a housing 402, shown in FIG. 4. If desired, an alignment feature 128 can be molded into front end 110 to provide orientation of the connector assembly 100 into a mating receptacle. Thus, contact pins 122 need not be used for alignment purposes.

Figure 3:
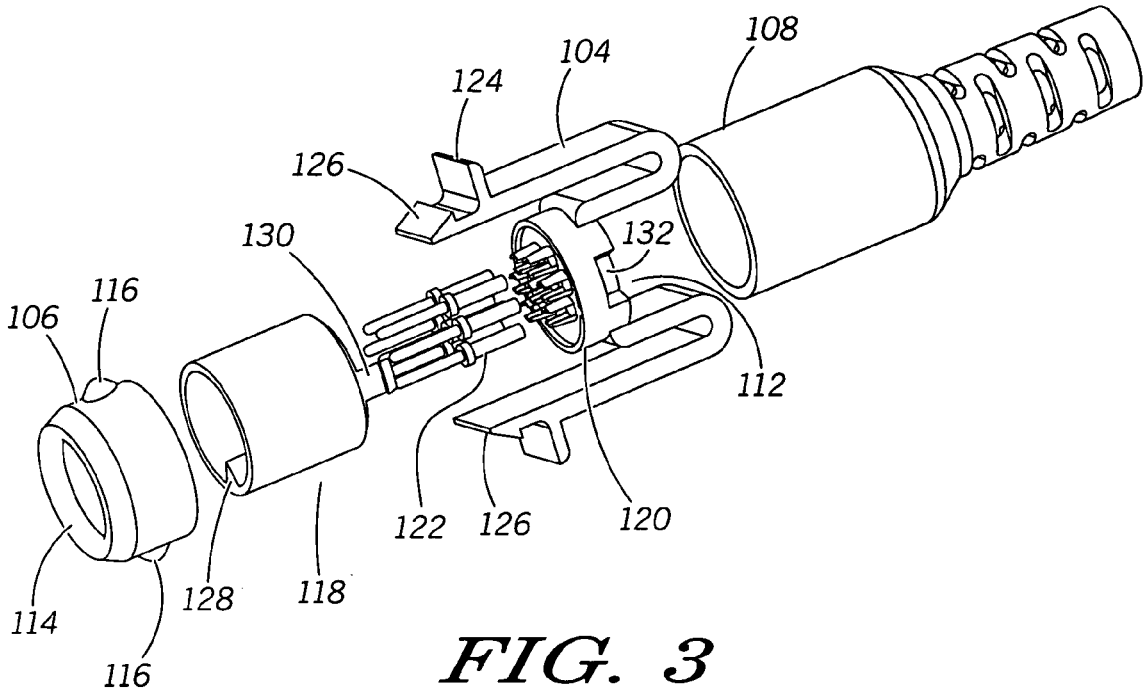
FIG. 3 is an exploded view of the connector assembly in accordance with an alternative embodiment of the invention.

FIG. 3 shows an alternative embodiment of the connector assembly in which the cylindrical body 102 is formed of first and second sections 118, 120 as opposed to the single piece shown in FIG. 2. This alternative embodiment allows for multiple connector mating configurations to be achieved by interchanging first section 118 while maintaining section 120 constant. Each configuration of section 118 has its own alignment feature 128 keyed for a predetermined receptacle. Section 118 can be removed or added from section 120 through the use of tabs 130 interconnecting and disconnecting to slots 132.

The locking arms 104 are preferably formed as part of the cylindrical body's back end 112 of second section 120. Each locking arm forms a "u" shaped member that extends upward from the back end 112 and turns downward alongside the cylindrical body 102 when the first and second sections 118, 120 are coupled together. The advantage of the alternative embodiment is that the second section 120 can be used as a base for a variety of interchangeable configurations achieved by substituting in different first sections 118.

Figure 4:
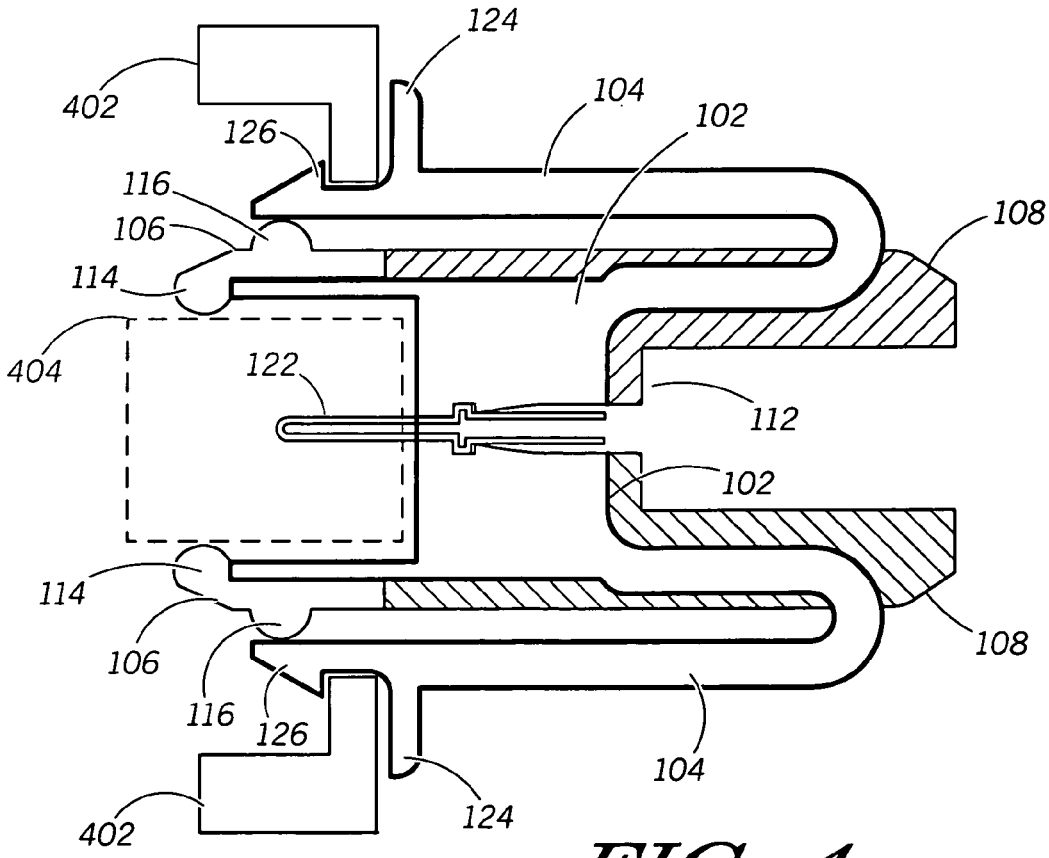
FIG. 4 is a cross sectional view of the connector assembly in accordance with the present invention.

FIG. 4 is a cross sectional view of the connector assembly 100 mounted in a communication device housing 402 in accordance with the present invention. The communication device housing 402, such as a mobile radio housing, is shown with the connector assembly 100 of the present invention plugged into a mating receptacle 404 of the housing. Connector assembly 100 is inserted into the housing 402 by squeezing the locking arms 104 thereby compressing the bumps 116 and then sliding the assembly 100 into the housing until stopped by the stop tab 124 and latching an edge of the housing with latch 126. The resistance created by the bumps 116 and locking arms 104 ensures that when the connector cable is pulled, the stop tabs 124 do not collapse. Thus, the connection between the locking arms 104 and the housing 402 does not fail.

The cross sectional view of FIG. 4 shows how the interior lip 114 of the malleable collar 106 of the present invention abuts with the front end 110 of the cylindrical body 102. In accordance with the present invention, the exterior bumps 116 align in between the locking arms 104 and the cylindrical body 102 to provide resistance to the locking arms when the locking arms are compressed within the housing. In accordance with the present invention, lip 114 seals about mating receptacle 404. A single contact pin 122 is shown loaded within the cylindrical body 102 and mating to receptacle 404.

Accordingly, there has been provided a connector assembly with improved retention and sealing features. The use of a malleable collar having an interior lip and exterior bumps along with the compressible locking arms of the cylindrical body provides improved retention and sealing to a receptacle. By forming the cylindrical body of two sections and providing an alignment feature, further advantages can be achieved by the ability to interchange a variety mating configurations.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as defined by the appended claims.

What is claimed is:

1. An electrical connector assembly, comprising:

a cylindrical body having a first end and a second end;

at least one locking arm extending from the first to the second end of the cylindrical body;

an elastomeric collar for sliding over the second end of the cylindrical body, the elastomeric collar having a lip for abutting with the second end of the cylindrical body; and at least one bump for every locking arm, each bump integrally molded on the elastomeric collar, each bump aligning under each locking arm and providing resistance to the locking arm when the locking arm is compressed against the cylindrical body.

2. An electrical connector assembly, comprising:

a first unitary molded portion formed of a substantially rigid cylindrical body having a front end and a back end and having at least one locking arm extending therefrom, each locking arm having a stop tab; and a second unitary molded portion formed of a elastomeric collar that slides over the front end of the cylindrical body, the collar having an interior lip that abuts with the back end of the cylindrical body, an elastomeric collar having an outer surface with at least one bump, the at least one bump being compressibly retained by the at least one locking arm when the collar is slid over the cylindrical body.

3. The connector assembly of claim 2, wherein the electrical connector assembly is inserted into a housing by squeezing the locking arms to compress the bumps to slide the assembly into the housing until stopped by the stop tab.

4. An electrical communication device, comprising:

a housing;

a cable for plugging into a mating receptacle of the housing, the cable comprising:

a strain relief overmold portion;

a connector assembly, comprising:

a cylindrical body having a front end and a back end, the front end being open and the back end enclosing a plurality of contact pins, the back end being overmolded by the strain relief overmold portion;

a plurality of locking arms extending upward from the back end and turning downward along the cylindrical body; and an integrally molded an elastomeric collar having an interior lip and exterior bumps, an elastomeric collar sliding over the front end of the cylindrical body such that the interior lip abuts with the front end of the cylindrical body and the exterior bumps align in between the locking arms and the cylindrical body, the exterior bumps providing resistance to the locking arms when the locking arms are compressed within the housing, and the lip sealing around the mating receptacle.

5. The communication device of claim 4, wherein the electrical connector assembly further comprises a stop tab and latch integrally molded within each locking arm.

6. The communication device of claim 5, wherein the electrical connector assembly is inserted into the housing by squeezing the locking arms to compress the exterior bumps to slide the assembly into the housing until stopped by the stop tab and latch.

7. An electrical connector assembly, including:

a cylindrical body having locking arms extending therefrom; and an integrally molded an elastomeric collar coupled to the cylindrical body, the collar being shaped to provide resistance through the use of integral bumps and sealing through the use of an interior lip.

8. The electrical connector assembly of claim 7, further comprising a strain relief overmolded to the cylindrical body such that the locking arms and bumps remain exposed, the locking arms compressing an elastomeric collar's bumps.

9. The electrical connector assembly of claim 7, further including contacts loaded within the cylindrical body.

10. The electrical connector assembly of claim 7, wherein the cylindrical body is formed of first and second sections, the first section being interchangeable to provide different connector mating configurations.

11. The electrical connector assembly of claim 10, wherein the first section of the cylindrical body includes an alignment feature.

12. The electrical connector assembly of claim 11, wherein the locking arms form "u" shaped members that extend upward from the second section and turn downwards alongside the cylindrical body.

* * * * *